US005353870A

United States Patent [19]

Harris

[11] Patent Number: 5,353,870

[45] Date of Patent: Oct. 11, 1994

[54] WELL PURGING AND SAMPLING PUMP

[76] Inventor: Richard K. Harris, 13457-64th Pl. NE., Kirkland, Wash. 98034

[21] Appl. No.: 68,143

[22] Filed: May 28, 1993

[51] Int. Cl.[5] ..... E21B 43/12; F04B 19/02

[52] U.S. Cl. ..... 166/68; 166/105; 417/400; 417/402; 417/468

[58] Field of Search ..... 166/68, 68.5, 105, 107, 166/109, 110; 417/400, 402, 468

[56] References Cited

U.S. PATENT DOCUMENTS

| | | | |
|---|---|---|---|
| 1,166,098 | 12/1915 | Watson | 417/400 |
| 2,286,926 | 6/1942 | Parenti | 417/400 |
| 2,291,880 | 8/1942 | Coberly | 417/402 |
| 2,318,782 | 5/1943 | Jorgensen | 417/400 |
| 2,946,387 | 7/1960 | Hooker, Jr. | 166/105 |
| 3,582,238 | 6/1971 | Devine | 417/397 |
| 3,664,415 | 5/1972 | Wray et al. | 166/264 X |
| 3,779,671 | 12/1973 | Lybecker et al. | 417/393 |
| 3,856,085 | 12/1974 | Holden et al. | 166/264 |
| 3,858,649 | 1/1975 | Wray et al. | 166/162 |
| 4,013,385 | 3/1977 | Peterson | 417/402 X |
| 4,076,077 | 2/1978 | Nix et al. | 166/321 X |
| 4,341,266 | 7/1982 | Craig | 166/317 |
| 4,403,919 | 9/1983 | Stanton et al. | 417/53 |
| 4,489,779 | 12/1984 | Dickinson et al. | 166/64 |
| 4,585,060 | 4/1986 | Bernardin et al. | 166/64 |
| 4,617,999 | 10/1986 | Beck et al. | 166/372 |
| 4,726,743 | 2/1988 | Watts | 417/400 |
| 4,759,227 | 7/1988 | Timmons | 73/863.23 |
| 4,940,088 | 7/1990 | Goldschild | 166/109 |
| 5,147,185 | 9/1992 | Niehaus et al. | 417/394 |
| 5,147,561 | 9/1992 | Burge et al. | 210/747 |
| 5,186,253 | 2/1993 | Gustafson et al. | 166/77 |
| 5,191,801 | 3/1993 | Allen et al. | 73/864.34 |

FOREIGN PATENT DOCUMENTS 2566052 12/1985 France ..... 417/400

OTHER PUBLICATIONS

Information sheets on purging pump from REDI--FL02, 2 pages.

Information sheets on Model SP-84 Submersible Sampling Pump System from KECK Instruments, Inc., of Williamston, Mich, 2 pages.

Information sheets from Bennett Sample Pumps (Submersible Piston Pump—Models 140 and 1400), 3 pages.

Information sheets from TIMCO on ISOMEGA Bladder Pump System, Air or Gas Lift Pumps for Well Purging and Sampling, and Air Lift Pumps for Product Recovery, 2 pages.

Information sheets from QED GroundWater Specialists entitled SAMPLE PRO (Portable Sampling Pumps, pp. 5-6); Well Wizard (Pneumatic Bladder Sampling Pumps, pp. 10-11); and PULSEPUMP (Recovery Bladder Pump), p. 29

Information sheets from KVA Analytical Systems of Falmouth, Mass., entitled MODEL XP 100 Series (Expendable Purge and Sampling Mini Pump System), 2 pages.

*Primary Examiner*—Hoang C. Dang

*Attorney, Agent, or Firm*—Graybeal Jackson Haley & Johnson

[57] ABSTRACT

The disclosed well purging and sampling pump has a hydraulically actuated rim driven cylindrical pumping piston assisted by an internal precharged gas return spring all mounted coaxially within a pump housing cylinder suitable for being lowered into and supported by the hydraulic conduits for actuation and pump delivery.

8 Claims, 3 Drawing Sheets

WELL PURGING AND SAMPLING PUMP

BACKGROUND OF THE INVENTION

The present invention relates to pumps for sampling well water or water sites suspected of contamination and more particularly to pumps that are capable of both purging a well or water site prior to taking a sample.

Various types of pumps for the above purpose have been proposed, but for various reasons existing devices do not satisfy the diverse requirements of both purging and reliable sample taking. For example, many of the prior pumps that have been offered for sample taking include a rotating impeller that has the undesirable tendency to agitate or spin the water sample and destroy its efficacy. Other proposed pumps are based on air driven, alternately expanded and collapsed diaphragms that have some advantages, such as in isolating the water sample from the pump parts but is undesirable in the requirement of large, powerful air compressors at the well heads and in restrictions on the purging flow rate. Also, bladder type pumps tend to be limited to shallow wells and are susceptible to freezing up under certain operating conditions.

Hence, there is a need for a new pump design capable of the multipurpose operation suitable both for relatively large volume purging to enable rapid preparation of the bore hole prior to taking a sample, and for low volume flow sampling for delivering water samples that are not agitated, spun or otherwise disturbed from the natural state of the water as it existed in the undisturbed well hole. In providing such a multipurpose purging and sampling pump, it is also desirable to provide a construction that maintains isolation of the water samples taken from any source of contamination, and to be able to use a conventional, relatively power efficient well head drive source to operate the pump.

SUMMARY OF THE INVENTION

In accordance with the above background and objects, the present invention provides a variable flow rate, non-contaminating, well purging and sampling pump that features a hydraulically actuated rim driven cylindrical pumping piston assisted by a precharged gas, such as air, return spring all mounted coaxially within a pump housing hollow cylinder suitable for being lowered into and supported by the actuating hydraulic conduits for actuation and delivery. More particularly, in the preferred embodiment disclosed herein, the pump is housed in a substantially hollow cylinder closed at opposite ends by fittings, one of which accommodates the conduits for both the actuating hydraulic pressure and the discharge flow. The opposite closed end fitting of the housing has an air or other gas valve for precharging the air spring chamber that provides the return force for the delivery stroke of the pumping piston. Mounted in coaxial alignment with the air spring return piston is a hydraulically actuated rim driven hollow pumping cylinder that reciprocates between a delivery stroke and an intake stroke. One of the ends of the pumping piston is substantially open so as to slide in reciprocation over a stationary annular valving head that is supported at the end of a delivery or discharge conduit. The stationary annular valving head supports a flapper valve that opens during the delivery stroke and closes for the intake stroke. A closed end of the pumping piston is provided with another flapper valve that closes during the delivery stroke and opens during the intake stroke to pull in by suction, water within the well through intake ports that open radially through the pump housing cylinder wall. The hydraulic drive fluid is delivered down hole through the actuating conduit into the pump housing so as to cause a pumping piston intake stroke during the high pressure phase of the hydraulic duty cycle, whereafter the hydraulic pressure is vented at the well head to allow the pump's internal air spring to force the pumping piston in a delivery stroke returning it to its original position completing the pumping cycle.

Further in accordance with the preferred embodiment, the well head power plant includes an interface cylinder assembly that isolates the alternately pressurized hydraulic fluid, typically oil or mineral water, from decontaminated fluid such as deionized water that is the actuating hydraulic fluid conducted down hole to the pump. In this manner, the pump internal components remain uncontaminated by the hydraulic actuating fluid which otherwise would tend to migrate across the piston seals into the pumping chambers of the pump and contaminate the sampled water.

The pump components are configured so as to be easily assembled and disassembled for facilitating cleaning and decontamination, which are requirements for taking reliable samples as well as avoiding cross contamination between a succession of well sites. Furthermore, there are only a few moving parts in the assembly and, except for the O-ring seals and flapper valves, all parts of the pump are made of stainless steel to facilitate the cleansing and decontamination procedure.

BRIEF DESCRIPTION OF THE DRAWINGS

These and further features, objects and advantages of the invention will become apparent to those skilled in the art from the following detailed description and appended drawings.

FIGS. 2A and 2B are axial sectional views of the pump itself showing the internal pumping piston and air spring return piston disposed in their most extreme positions in which FIG. 2A shows the components in a position prior to the intake stroke and FIG. 2B shows the components in the position just prior to the delivery stroke.

DETAILED DESCRIPTION

Figure 1:
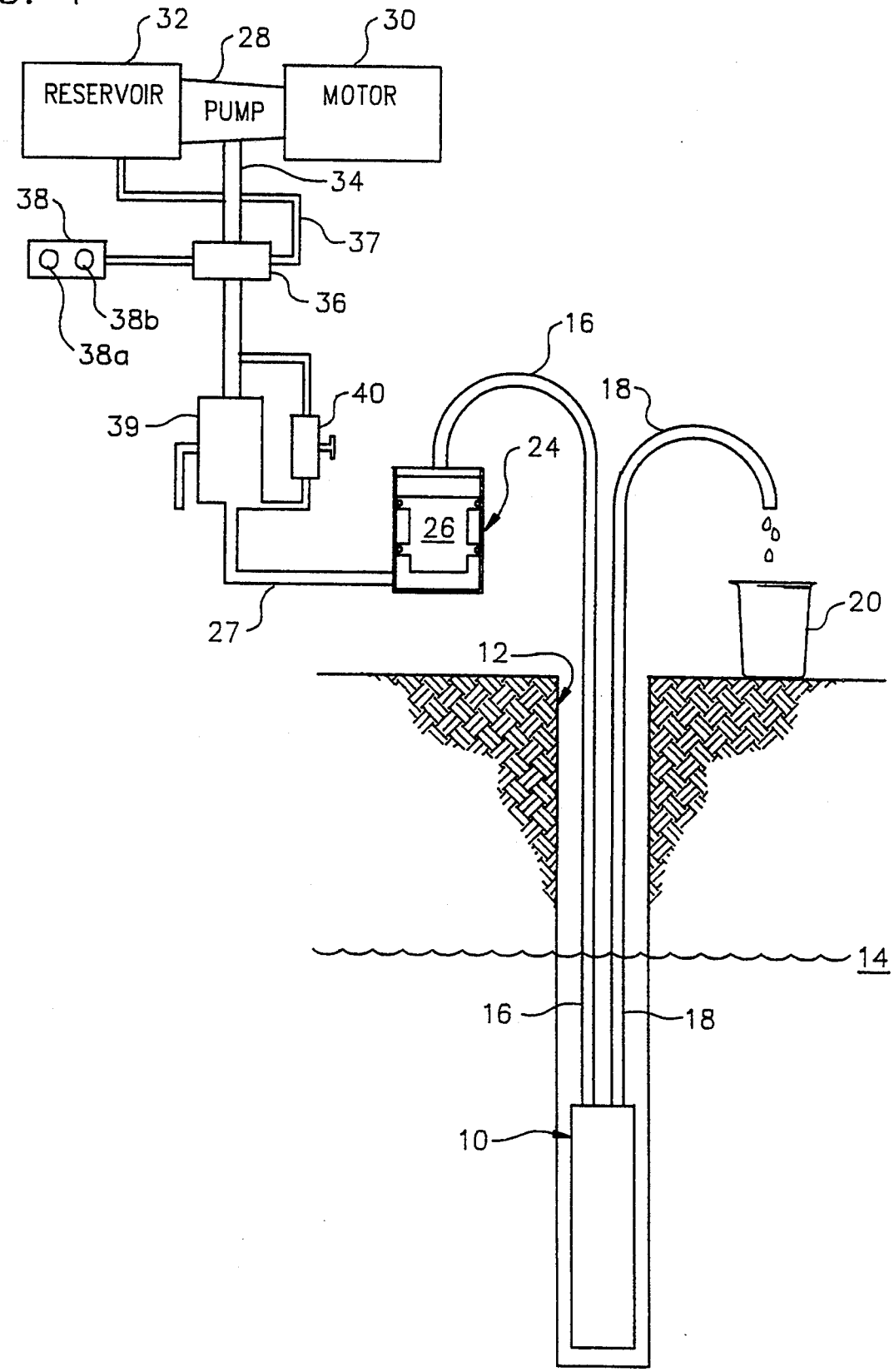
FIG. 1 is a generalized block diagram in somewhat schematic form showing the entire system of the purging and sampling pump and its hydraulic power actuation at the well head, including the interface cylinder assembly.

With reference to FIG. 1, the variable flow rate, non-contaminating well purging and sampling pump 10 is shown installed down-hole in a well bore 12 below the water (or other fluid) level that is to be sampled. Actuation is by alternately pressurized and vented hydraulic fluid communicated down to pump 10 from the well head by a down hole conduit 16. The pumped purging water and sample is fed up hole via a delivery conduit 18 as illustrated so that a sample can be taken in a beaker 20. To avoid contamination of the water (or other liquid) sampled from bore hole 12, the actuating pressure communicated down hole by conduit 16 is isolated from the conventional hydraulic drive fluid, typically an oil or mineral based fluid, by an interface cylinder 24. On the down hole side of interface cylinder 24 communicating with the down hole or hydraulic drive conduit 16, a non-contaminating liquid such as deionized water is employed.

Figure 5:
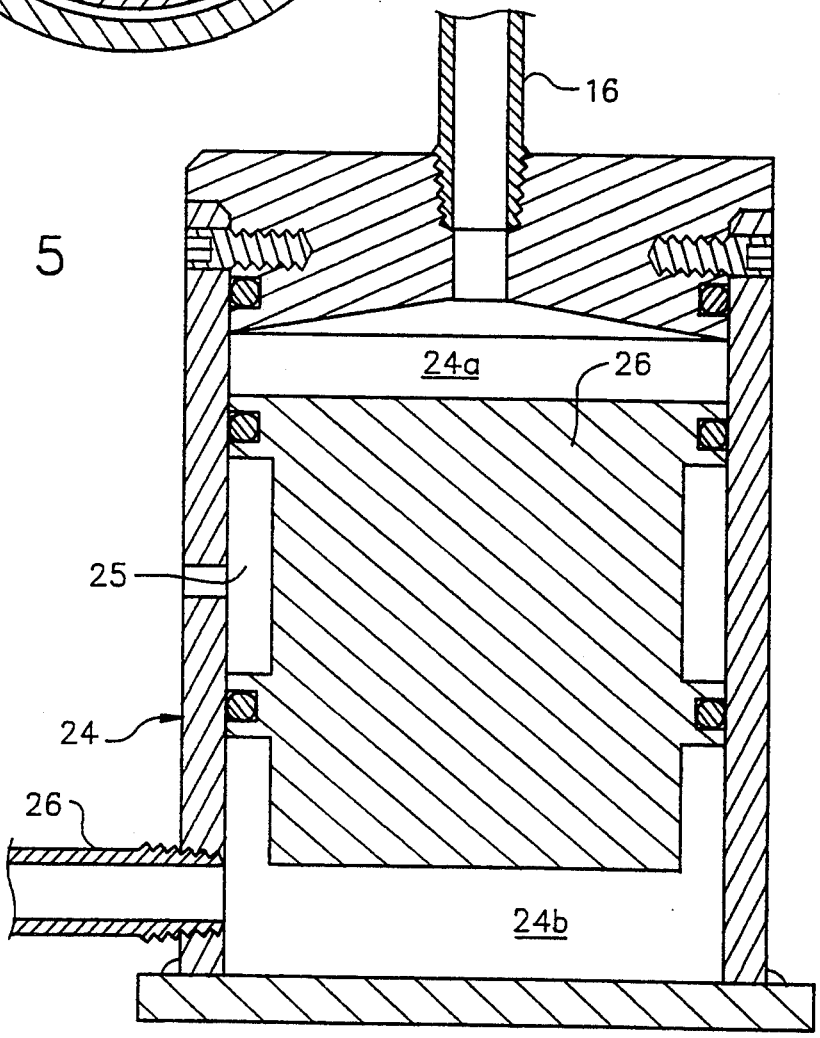
FIG. 5 is a vertical and axial sectional view of the interface cylinder depicted in FIG. 1 for isolating the hydraulic actuation fluid delivered by the well head pressure source and switching valve from the relatively pure deionized water that is used in the down hole conduit for actuating the purging and sampling pumping piston.

Interface cylinder 24, shown more clearly in FIG. 5, includes an isolation piston 26 that floats between the deionized water in the upper chamber 24*a* of the cylinder 24 and a lower chamber 24*b* to which alternately pressured and vented hydraulic fluid, such as oil, is applied from a switched valved, pumped oil source fed into the interface cylinder by conduit 27. Piston 26 has axially spaced O-ring seals disposed on opposite sides of an air vented fluid isolation chamber 25 to ensure separation of the fluids.

In a conventional manner, a source of pressurized hydraulic fluid is developed by a pump 28 cooperating with pump motor 30 and an oil reservoir 32 forcing the hydraulic drive fluid down through line 34 to a timed switching valve 36 that is controlled by an electronic timer 38 having rate (frequency) and duty cycle controls 38*a* and 38*b* such as available commercially from National Controls Corporation. Timer 38 operates switching valve 36, which may be a conventional solenoid valve, to alternately switch between a relatively high pressure mode that communicates the pressurized hydraulic fluid (oil) from pump 28 down through parallel by-pass and metering valves 39 and 40, respectively, to conduit 27, and a low pressure mode in which oil is vented over line 37 back to reservoir 32. By-pass valve 39 is a manually operated gate valve that will be opened during relatively high pumping rates, such as for purging, and normally closed during sampling to force the actuation fluid through a one-way adjustable metering valve 40. This is a commercially available device, such as a Parker Flow Control Valve Model 4005-11JD, and has an internal one-way ball valve that opens in the down hole direction to apply periodic surges of actuation pressure to the pump for its intake strokes and closes in the reverse direction to cause the return actuation flow (vented) to be at a slower adjustably metered rate through a parallel internal metering passage. The slower metered flow rate occurs during the air spring return (pumping) stroke, discussed herein, to deliver the well sample within the flow limits required for a reliable test sample.

Figure 2A:
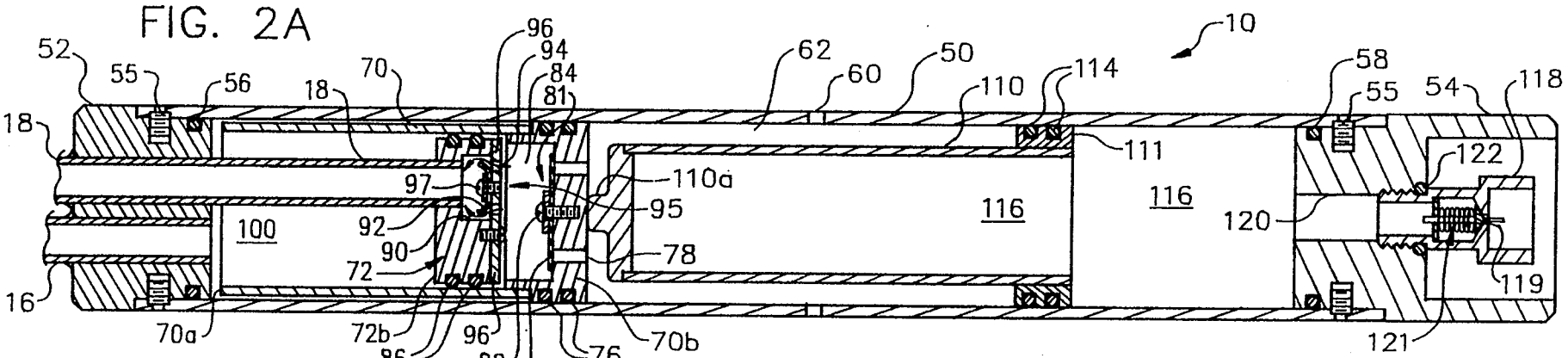
Figure 2B:
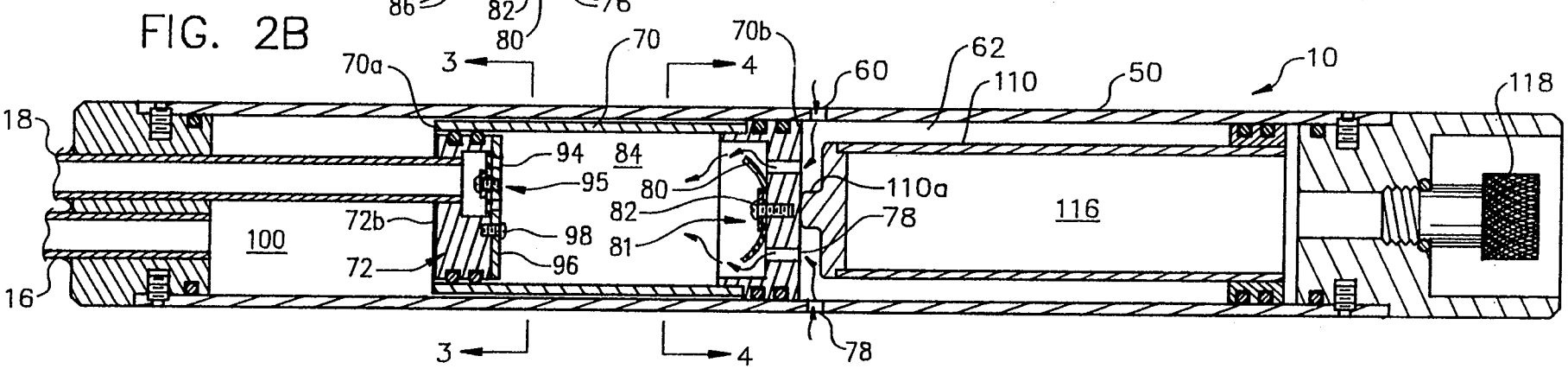

With reference to FIGS. 2A and 2B, pump 10 itself, constructed in accordance with the invention, is a hydraulically reciprocating piston pump with an air spring return shown respectively in two extreme modes of reciprocation. FIG. 2A depicts the pump assembly in a state just at the end of the delivery or pumping stroke and preceding the intake stroke. FIG. 2B shows the assembly completing the intake stroke and about to commence the delivery stroke. With reference to both figures, pump 10 has a substantially hollow cylindrical housing 50 closed at a first end (left side of the figures) by an end plug fitting 52 and closed at the other end by an end plug fitting 54, each of which fit inside the cylinder wall and is secured by radially disposed turned down set screws 55 threaded into radial bores formed in fittings 52 and 54 and secured by backing them out into undersized openings in the wall of cylinder 50. O-ring seals 56 and 58 are disposed at each end fitting to seal between the interior wall of housing 50 and the reduced diameter portion of end fittings 52 and 54, respectively.

Figure 3:
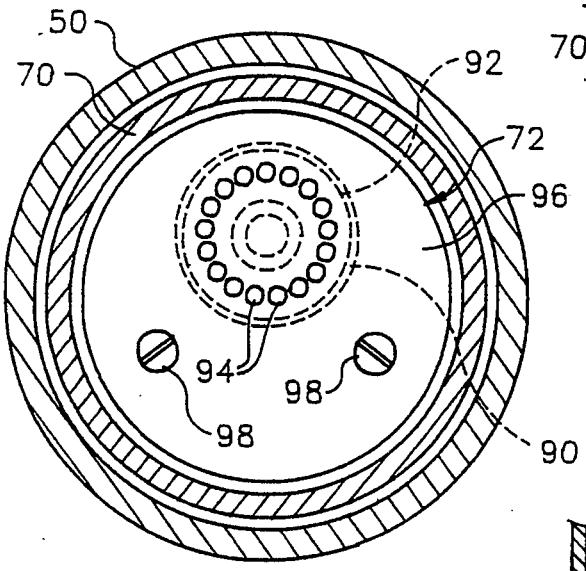
FIG. 3 is a transverse sectional view taken along section line 3—3 of FIG. 2B and FIG. 4 similarly is a transverse sectional view taken along section line 4—4 of FIG. 2B.
Figure 4:
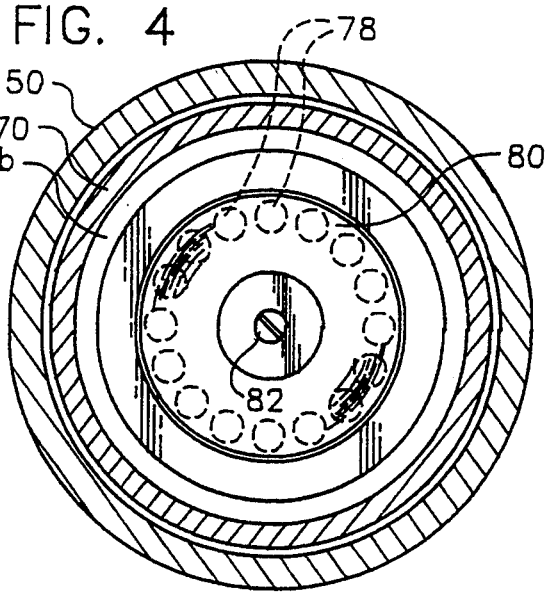

About mid-length, housing 50 has radially and circumferentially disposed intake ports 60 that allow water or other liquid within the bore-hole 12 (see FIG. 1) to be pulled in by suction of the pump into an intake chamber 62. Positioned for co-axially reciprocating adjacent the first end fitting 52 is a hydraulically actuated rim driven substantially hollow pumping piston 70 that is open at the end 70*a* adjacent fitting 52 to slide over and reciprocate relative to an interior stationary annular head assembly 72 having a flapper type delivery valve mounted therein and being supported at the end of delivery pipe or conduit 18. The opposite end of pumping piston 70 is substantially closed by a head 70*b* that, in this embodiment, is a separate annular piece welded to the hollow cylinder body of piston 70 and is provided with axially spaced double O-ring seals indicated at 76. A circular array of intake ports 78 extend through the otherwise closed head 70*b* (see FIG. 3) and cooperate with a flapper 80 of flexible synthetic material held in place on the inside of piston head 70*b* by screw fastener 82 to form a one-way intake valve assembly 81. During the intake stroke, flapper 80 opens to allow valve ports 78 to suck water or other fluid in through pump intake ports 60 of the pump housing and into the expanding volume of chamber 84 as the pumping piston 70 reciprocates from left to right relative to the stationery head assembly 72.

Head assembly 72, as indicated, is an annular head 72*b* of axial dimension sufficient to accommodate the axially spaced double O-ring seals 86 and is mechanically supported in a fixed position at the end of delivery conduit 18 which, in this embodiment, is a rigid metal pipe passing through end fitting 52 and welded and sealed in place in a bore through the end fitting 52. Conduit 18 may be provided with a fitting coupling (not shown) to connect it outside of the pump housing to the variable length run of down hole conduit.

The conduit 18 extends within pump housing 50, in this embodiment, parallel and offset to the axis of the assembly from left to right, as shown in the figures, terminating roughly one-fourth of the axial length of housing 50 between end fittings 52 and 54. Annular head 72*b* has an eccentric bore 90 in line with conduit 18 provided with a one-way flapper 92 that serves with ports 94 in a head cover plate 96 as a one-way delivery valve assembly 95 which opens when chamber 84 is full to accommodate discharge or delivery flow into conduit 18 in the delivery stroke. Flapper 92 closes these ports 94 during the intake stroke. In this embodiment, flapper valve assembly 95 is formed on and supported by the circular plate 96 that has a circular array of ports 94 eccentrically located on plate 96 and is held in place by screw fasteners 98 (see FIG. 3). Flapper 92 is of a material like flapper 80 and is secured by a screw fastener 97 on the inside wall of head plate 96.

The alternately pressurized and vented actuating fluid, in this case being the deionized water fed down hole by conduit 16, is communicated to the interior of actuating chamber 100 between end fitting 52 and the hollow cylindrical end of pumping piston 70 so as to cause at the pressurized phase of the duty cycle, a piston driving force that acts just on the rim or circular edge of the piston 70 cylindrical body, forcing piston 70 from left to right, as shown in the figures, in an intake stroke. When conduit 16 is vented by the well head actuating source, pumping piston 70 is relieved of this rim drive pressure and, as to be described below, the piston is powered in a delivery stroke from left to right by an air return spring. Conduit 16, like conduit 18, may be provided with a coupling fitting (not shown) outside pump 10 to accommodate the variable length of down hole pipe.

As shown in FIGS. 2A and 2B, an air spring return piston 110 is mounted between the right hand end fitting 54 of the pump housing and head **70*b* of pumping piston 70. The air spring return piston 110 is an elongated cylindrical or tubular structure of outside diameter less than that of the interior diameter of housing 50 so as to not obstruct ports 60. A water intake chamber 62 is thus formed between the inside wall of housing 50 and the outer diameter of air spring return piston 110 that communicates with the intake ports 78 on pump piston head 70*b*. The tubular or cylindrical body of air spring return piston 110 has a closed driving end 110*a* which in turn has an external axial protrusion centrally 20 located to engage and maintain a biased force against pumping piston 70 at its closed end 70*b* as illustrated. The other end of piston 110, adjacent end fitting 54, is provided with a double O-ring seal retainer 111 that is of sufficient axial dimension to accommodate the dual O-rings indicated at 114 and is of a radial thickness sufficient to fill the annular space between the smaller diameter piston 110 and the interior wall of pump housing 50 and to form a pressure tight, compressible air chamber 116**.

Chamber 116 is preloaded to a suitable return spring pressure by an air valve 118 that is mounted and sealed in a interiorally threaded axial bore 120 in end fitting 54 with O-ring 122. Air valve 118 is a conventional device having an internal air passage 119 within which a normally closed one-way spring biased valve assembly 121 is mounted that is forced open during charging. The air pressure chamber 116 is precharged to a suitable gas pressure at the well head prior to placement down hole.

All of the parts of pump 10 except for the O-ring seals and flappers are stainless steel so that the entire pump can be disassembled and all parts cleaned and decontaminated after purging and/or sampling of a well and prior to the installation at another test site. The O-ring seals and flappers are made of a non-contaminating cleanable synthetic elastomer such as viton. For this procedure, as shown in FIGS. 2A and 2B, the end fittings 52 and 54 are removed by screwing set screws 55 inwardly to cause the screw heads to be positioned flush with the reduced diameter surfaces of the fittings 52 and 54 and then these end fittings can be pulled from the body of cylinder housing 50. Removal of the end fitting 52 relative to housing 50 brings with it the stationary annular head assembly 72 and its associated components and thereafter the pumping piston 70 and air spring return piston 110 are withdrawn from either end of the pump housing assembly.

In operation, after reassembling pump 10 following cleansing and decontamination, the pump is operated as described in accordance with the description of FIG. 1 to alternately receive pressurized deionized water via conduit 26, interface 24 and down hole actuating conduit 16 to drive the pumping piston 70 in a reciprocating motion against the return air spring created by the preloaded air pressure acting on return piston 110 in chamber 116. The normal unactuated state of the pump is shown in FIG. 2A, with the return air spring causing piston 110 to force the pumping piston 70 toward end fitting 52, hence in the lefthand-most position as shown in the figures. As the first pulse of pressurized actuating fluid is injected into actuating conduit 16, the rising pressure in chamber 100 is applied to the relatively small effective piston area at the cylindrical edge or rim **70*a* of piston 70** forcing it toward the opposite end of the pump assembly against the air spring.

It is noted that the actuating pressure acting on piston 70 has only the effective rim area, namely the radial thickness of the cylinder edge, on which to act, which for example in the enclosed embodiment, is only 0.38 square inches for a piston cylinder of about 1.6 inches in diameter. All other surfaces within this chamber 100 are either stationary or parallel to the axis of the assembly and hence cause no reactive reciprocation along the axis of the assembly. Piston 70 is hence driven under this actuation pressure from left to right forcing air spring piston 110 also from left to right at the engagement point of protrusion **110*a* compressing the precharged air (or other gas) in chamber 116 into a higher than normal pressurized state and moving the internal pistons as shown in FIG. 2B to position toward end fitting 54 and causing a reduced pressure in pump chamber 84. Since the air pressure in chamber 116 is acting on a larger effective piston area, in this example on 2.4 square inches for an air piston diameter of about 1.75 inches, the amount of air pressure needed to bias the pumping piston 70 and drive it in a return pumping stroke is lower than the hydraulic actuation pressure here by a factor of $2.4/0.38 \cong 6$. This ratio in turn allows for relatively low and safe air pressure levels while permitting relatively larger hydraulic actuation pressure for sure positive displacement of pumping piston 70**. High levels of compressed air (or other gas) is inherently more dangerous in this type of equipment than hydraulic fluids at comparable high pressure.

During the intake stroke, water or other liquid to be pumped within the bore hole is forced or sucked into the pump through ports 60 and open flapper valve bores 78 of the piston head **70*b* filling the chamber 84 with water. When the alternating drive pressure switches at switching valve 36 to a vented condition, the pressure in conduits 26 and 16 drops to close to atmospheric pressure and the fluid pressure within the chamber 100 likewise drops. This reduced pressure in chamber 100 lowers the fluid pressure acting on the rim 70*a* of piston 70 and allows the compressed gas or air spring in chamber 116 to force return piston 110 from right to left, as shown in the figures, returning the pumping piston head 70*b* and cylindrical piston body 70 from right to left. This operation in turn elevates the pressure of the trapped water within chamber 84 closing flapper 80 and opening flapper 92 forcing the water out through delivery conduit 18** and up to the well head.

Typically, to inspect and take samples of well water or other ground water that is to be evaluated, it is necessary to purge the water within bore hole 12 one or more times before an acceptable sample is to be taken. The purging of a well will typically require a higher rate of flow volume than is mandated for taking the sample itself. To accommodate this procedure, the frequency and duty cycle of the alternating actuating pressure of electronic timer 38 and its associated switching valve 36 is increased significantly from a low sampling pumping rate to a higher purging rate. This is the purging process, and when the water within bore hole 12 has been purged one or the number of times required, which is typically two or three times, then it is desirable to take a sample at a lower rate that minimizes the amount of stirring or mixing of the ground water impurities. Therefore, after purging, the timer 38 is reduced at control 38*a* to a lower operating frequency to take the sample with less disturbance to the well.

A typical sampling rate for ground water testing is in the range of 50 to 100 milliliters per minute. A purging rate would be on the order of 25 to 40 liters per minute, or a factor of 250 higher than the sampling rate. Pump 10 is also useful not only for purging and sampling but for well development. Development rates in which water is drawn from the well over prolonged periods of time at moderate rates may be in a range between the purging and sampling rates but over a prolonged period. These variable rates demonstrate the versatility of pump 10 in being able to accommodate different volume flows without changing any of the pump components and simply by adjusting the frequency and/or duty cycle of the electronic timer 38 and/or the metering rate of the pumping stroke at metering valve. To provide these variable flow rates, the actuation cycle frequency can vary over a wide range. For example, at the purging flow rate this embodiment operates up to about 70 cycles per minute and can vary down to an extremely slow sampling rate of reciprocation of about 1 cycle per minute.

Furthermore, by the unique construction of the pump, only a small volume of actuating hydraulic flow is required to operate the pump. This is due to the fact that the only change in volume of chamber 100 during actuation is the incremental increase in the interior of this part of the pump as the rim or cylinder edge 70*a* of piston 70 moves from left to right during the intake stroke and return delivery stroke. By requiring only this minimal hydraulic actuation volume flow, operating efficiency is enhanced because of reduced line friction and minimization of cavitation potential.

Figure 6:
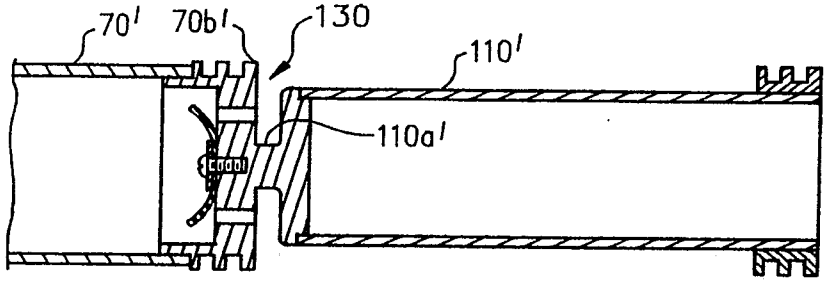
FIG. 6 is an axial sectional view of an alternative embodiment of the pumping and gas spring return piston made as one unit.

The alternative embodiment of FIG. 6 shows pumping piston 70' (corresponding parts are identified by a primed reference number) and the gas spring return piston 110' fabricated as one unit. The corresponding parts are shown removed from the pump housing and without O-ring seals, joined at 130 by an annular connective member 110*a'* that integrates head 70*b* and end 110 into a unitary assembly.

While only particular embodiments have been disclosed herein, it will be readily apparent to persons skilled in the art that numerous changes and modifications can be made thereto, including the use of equivalent devices and method steps, without departing from the spirit of the invention.

What is claimed is:

1. A variable flow rate, non-contaminating, well purging and sampling pump, comprising:

a substantially hollow cylindrical pump housing closed at its first and second ends and having an intake port opening radially through the housing cylindrical wall intermediate the first and second closed ends;

a hydraulically actuated rim driven substantially hollow cylindrical pumping piston substantially closed at one end and mounted coaxially within said pump housing for reciprocating between a delivery stroke and an intake stroke, a one-way intake valve disposed on the substantially closed end of said pumping piston for opening to draw fluid into a pumping chamber during an intake stroke;

a stationary annular head disposed in coaxially slideably sealed engagement with the interior wall of said hollow cylindrical pumping piston adjacent its open end, said stationary annular head is supported by an end of a delivery conduit that passes through said first end of said pump housing;

a one-way delivery valve mounted in said stationary annular head for opening to discharge fluid in said pumping chamber between said annular head and the substantially closed end of said pumping piston during a delivery stroke;

a hydraulic actuating fluid inlet passing through said first closed end of said housing so as to communicate a source of alternately pressurized and vented hydraulic actuating fluid into said housing so as to drive said pumping piston at the rim of its substantially open cylindrical end away from said first end of said pump housing in an intake stroke; and a gas spring return piston mounted for coaxial sliding sealed reciprocation within said pump housing adjacent its second closed end so as to trap compressible gas in a variable volume chamber therebetween, said pumping piston forcing said gas spring return piston to compress gas in said variable volume chamber during an intake stroke to store energy and said compressed gas powering said gas spring return piston to drive said pumping piston in a delivery stroke when the hydraulic drive pressure acting on the pumping piston is vented.

2. The variable flow rate, non-contaminating well purging and sampling pump of claim 1, wherein said one-way intake valve is a flapper valve having a flexible material mounted on the substantially closed end of said pumping piston so as to alternately open and close an axially extending intake port during the intake and delivery strokes, respectively.

3. The variable flow rate, non-contaminating well purging and sampling pump of claim 1, wherein the delivery one-way valve is a flapper valve having a flexible material disposed on said stationary annular head so as to alternately close and open a discharge port through said head during intake and delivery strokes, respectively.

4. The variable flow rate, non-contaminating well purging and sampling pump of claim 1, wherein said second closed end of said cylindrical pump housing comprises a screw mounted air valve for preloading gas into the variable volume chamber for establishing the spring return rate of said gas spring return piston.

5. The variable flow rate, non-contaminating well purging and sampling pump of claim 1, further comprising an interface cylinder means mounted in line with said hydraulic actuating inlet so as to isolate pump source hydraulic actuating fluid from non-contaminating fluid that is in communication with the interior of said cylindrical pump housing at said actuating inlet.

6. The variable flow rate, non-contaminating well purging and sampling pump of claim 1, further comprising a well head hydraulic actuation pump for producing a source of non-water based hydraulic fluid at alternating relatively high and low pressure and an interface cylinder communicating pressure between said non-water based hydraulic fluid and the actuating inlet of said pump housing, and a non-contaminating fluid other than said non-water based hydraulic fluid filling the actuating inlet and the associated inlet conduit.

7. The variable flow rate, non-contaminated well purging and sampling pump of claim 1, comprising means for selectively varying the cyclical rate of said alternately pressured and vented hydraulic actuating fluid, whereby the flow rate of the pump is varied between purging and sampling rates.

8. A hydraulically actuated, variable flow rate pump suitable for shallow or deep well sites, comprising:

a substantially hollow cylindrical pump housing closed at opposed ends and having an intake port in the cylinder wall intermediate its ends;

a pumping piston having an open hollow cylindrical end defining a rim and a closed end and mounted for coaxial reciprocation within said housing adjacent a first end;

an intake one-way valve mounted in said closed end of said pumping piston;

a stationary annular head coaxially mounted in said housing adjacent said first end so that said open hollow cylindrical end of said pumping piston slides over said head;

a delivery one-way valve mounted in said stationary annular head;

actuation fluid conduit means communicating with a chamber between said stationary annular head and said first end of said housing for driving said pumping piston in an intake stroke by actuation fluid pressure on the rim of said open hollow cylindrical end; and gas return spring piston means mounted in said housing adjacent its second end for driving said pumping piston in a delivery stroke following said intake stroke.

* * * * *